United States Patent [19]

Durham

[11] 4,030,626

[45] June 21, 1977

[54] CLAMP FOR SCOOP LOADER

[76] Inventor: Harvey Durham, P.O. Box 164, Manila, Ark. 72442

[22] Filed: May 7, 1976

[21] Appl. No.: 684,430

[52] U.S. Cl. ..... 214/767; 37/118 A; 214/147 R

[51] Int. Cl.² ..... E02F 3/44

[58] Field of Search ..... 214/144, 145 R, 146 E, 214/147 R, 510, 767, 82; 37/118 R, 118 A, DIG. 3, DIG. 4, DIG. 12; 294/67 AB

[56] References Cited

UNITED STATES PATENTS

| | | | |
|---|---|---|---|
| 3,057,496 | 10/1962 | Garske | 214/767 |
| 3,140,001 | 7/1964 | Strader | 214/146 E X |
| 3,235,108 | 2/1966 | Drakulich | 294/67 AB X |
| 3,273,729 | 9/1966 | Holopainen | 214/147 R X |
| 3,451,575 | 6/1969 | Petro | 214/767 |
| 3,477,602 | 11/1969 | Peterson | 214/767 |
| 3,581,924 | 6/1971 | Marz | 214/767 |

FOREIGN PATENTS OR APPLICATIONS

| | | | |
|---|---|---|---|
| 804,872 | 11/1958 | United Kingdom | 214/144 |

*Primary Examiner*—L. J. Paperner
*Attorney, Agent, or Firm*—Dowell & Dowell

[57] ABSTRACT

An hydraulically operated clamping assembly for a scoop loader of the type having a bucket mounted on a vehicle, the clamping assembly including means for supporting a clamping blade pivoted adjacent the top edge of the bucket so that the blade can be positioned selectively to occupy any position between an outwardly extended position and a retracted position wherein the blade is fully housed within the bucket, the height of the blade as measured normal to the axis of the hinge being adjustable, and the pivotal position of the blade about said hinge being selectively determined by an hydraulic ram coupled to the blade and supported on a bracket attached to the bucket.

4 Claims, 2 Drawing Figures

CLAMP FOR SCOOP LOADER

FIELD OF INVENTION

Figure 1:
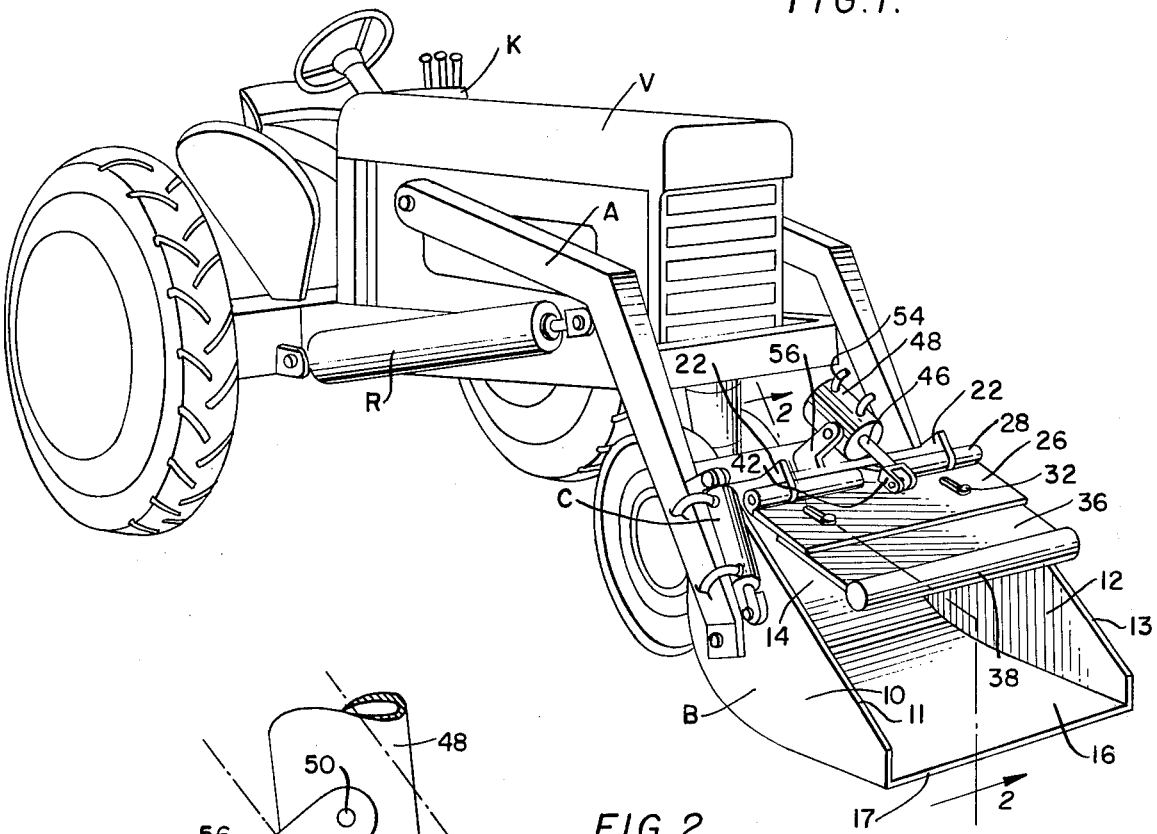

This invention relates to vehicle-mounted scoop loaders, and more particularly to an improved loose material clamping assembly attached to the bucket of the scoop loader and controlled by the vehicle's hydraulic system.

BACKGROUND AND PRIOR ART

During ordinary use of scoop loaders of the type carried by a vehicle, usually comprising a front end scoop, considerable difficulty is encountered in keeping the materials which are initially picked up by the bucket from falling back out of the bucket while the materials are being moved. Although it is relatively easy when loading granular materials or small objects to substantially fill the bucket, to tilt it back and to pick it up without much spillage, it becomes very much more difficult to pick up a load when the materials being loaded contain larger pieces of odd shapes, for instance, such as scraps of wood or pieces of wall board as encountered while scoping the debris resulting from the demolition of a building. Moreover, the scoop loader is frequently used for moving materials which simply do not fit into the bucket at all, such as long boards, or large area materials such as plywood sheet, etc.

As a consequence a number of different devices have been proposed for retaining the materials picked up by the bucket, and for clamping these materials in the case of relatively large pieces such as boards and sheets. U.S. Pat. No. 3,057,496 to Garske shows a front end loader having an hydraulically operated clamping blade which can be moved to a substantially closed position in which it contacts the front lip of the bucket, or can be opened to a raised position in which it extends forwardly of the bucket slightly above horizontal. There is no provision for placing the clamping blade in an out-of-service position where it does not interfere with the use of the device when it is not needed.

U.S. Pat. No. 3,451,575 to Petro shows another front end loader having a grill which can be lowered over the front of the bucket without entering into the bucket, the grill serving to prevent discharge of the materials within the bucket prior to intended discharge thereof. U.S. Pat. No. 3,077,999 to Svoboda shows still another front end loader which is functionally similar to that shown in the Petro patent.

There are also a number of patents showing devices attached to buckets which serve to scrape a vertical wall of materials downwardly, for instance, as shown in U.S. Pat. Nos. 3,252,606 to Pryor and 3,148,787 to Clark et al.

THE INVENTION AND ITS CONTACTS

The present invention provides an improved clamping assembly serving a purpose similar to the clamping assemblies shown in the above mentioned prior art, but improved in a number of ways.

It is a principal object of the invention to provide a clamping assembly for attachment to a scoop loader bucket, wherein the assembly during periods of non-use provides minimum interference with the normal performance of the scoop loader. In particular, in the disclosure according to the present invention the clamping blade enters into the bucket and moves substantially to the rear thereof to a retracted position where it is protected from accidental damage, where it does not substantially interfere with normal use of the bucket, where it is not in the operator's line of vision, and where it does not increase the width of the scoop loader assembly.

It is another object of the invention to provide an improved clamping assembly including an hydraulic ram wherein the assembly is mounted to the bucket along its top edge, and wherein the pivotal supports for the clamping blade and for the hydraulic ram are all placed such that the clamping blade can be retracted to a point near the back of the bucket where it is out of the way during periods of disuse.

Still a further object of the invention is to provide a clamping blade assembly hinged to the bucket about a pivotal axis which lies parallel to the top edge of the bucket, and wherein the height of the clamping blade, as measured outwardly normal to the pivotal axis, is adjustable, not only to lengthen its outer end in an optimum manner for the materials which it must clamp, but conversely to permit shortening of the height of the blade to permit retraction thereof to a maximum degree into the back of the bucket.

It is another object of the invention to position the pivotal axis of the blade slightly above the top edge of the side walls of the bucket and to shape the blade and bucket in such a manner that sheet materials can be easily handled by laying the sheet across the top edges of the side walls of the bucket and bringing the clamping blade down to overlie the sheet and hold it in place, whereby large sheet materials which could not otherwise be picked up by the loader can be efficiently and safely handled using the clamping assembly. It is deemed that a structure of this type greatly increases the safety of the combined bucket and clamping assembly to providing efficient means for supporting sheet materials so that they are not likely to be accidentally dropped causing possible damage and personal injuries.

Still another object of the invention is to provide an adjustable clamping blade assmebly wherein the outer edge of the clamping blade which normally approaches the bottom of the bucket is provided with a cylindrical bead, which not only thickness the clamping blade and reduces the liklihood that it will become bent, but also reduces the tendency of the lower edge of the blade to damage other material being handled by the machine.

A further object of the invention is to provide a clamping assembly including an hydraulic ram, wherein the connections between the ram and the blade and the location of the pivot of the blade provide a considerable mechanical advantage at the cylindrical clamping lip.

A further object of the invention is to provide a clamping assembly which is economical to make and easily installed upon a scoop loader bucket.

Other objects and advantages of the invention will become apparent during the following discussion of the drawings, wherein:

THE DRAWINGS

Figure 2:
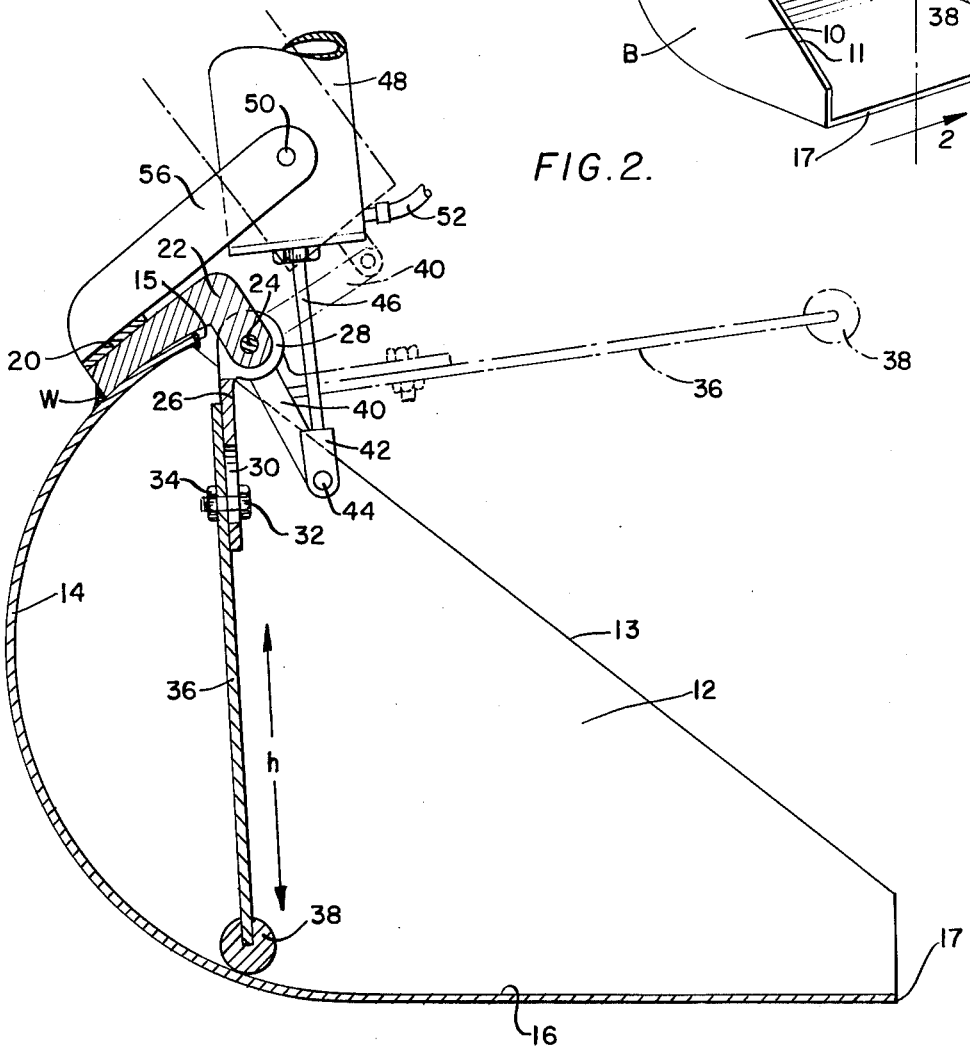

FIG. 1 is a perspective view of a vehicle having a scoop loader supported on its forward end, the scoop loader being provided with a clamping assembly according to the present invention; and FIG. 2 is an enlarged cross-sectional view taken along lines 2—2 of FIG. 1, but showing the clamping blade in a retracted position.

Referring now to the drawing, FIG. 1 shows a vehicle V having a self-contained hydraulic pressure system including a pump (not shown) controlled by hydraulic control levers K. The controls include two levers, one for controlling the height of the supporting arms A as determined by the main rams R, and the second for controlling the tilt of the bucket using the hydraulic cylinders C (of which there are two). The arms A support a bucket B comprising the scoop loading device. The bucket has two side walls 10 and 12, a rear wall 14, and a bottom wall 16 terminating at a scooping edge 17, the bucket of the scoop opening in a direction which will be referred to hereinafter as "outward". The side walls each have upper edges 11 and 13 which are preferably straight-line parallel edges according to the present disclosure. The rear wall 14 has a top edge 15 which will be referred to again hereinafter.

Referring now to both FIGS. 1 and 2, the material clamping assembly according to the present invention is supported by the rear wall 14 of the bucket as shown in the present illustrative embodiment and includes a mounting bar 20 which extends all the way across the top of the rear wall 14 near its edge 15 and is secured thereto as by welding W. The bar 20 supports first and second bracket means. The first bracket means includes two L-shaped brackets 22 which are welded to the support bar 20 and are spaced widely apart on opposite sides of the longitudinal center of the bucket. The brackets 22 each have a hole through their outer ends, and these holes support a hinge rod 24 which passes through the two brackets 22 and also passes through the tubular boss 28 of a hinge which will be presently discussed. The hinge rod 24 is located forward of the edge 15 and over the open space within the bucket, and is elevated slightly above the linear upper edges 11 and 13 of the side walls 10 and 12 of the bucket. The clamping blade means comprises two plates. The plate 26 is referred to herein as the hinge plate, and at its pivoted inner end it carries a circular tube 28 through which the hinge rod 24 passes. The hinge plate 26 is provided with several elongated slots 30 through which bolts 32 are passed, these bolts also passing through the adjacent clamping plate member 36, securing the plates 36 and 26 tightly together when the bolts 32 are tightened using the nuts 34. When the bolts 32 are loosened, the clamping plate 36 can be slid inwardly or outwardly with respect to the hinge rod 24, thereby changing the height *h* of the composite blade means 26–36 as measured perpendicularly from the hinge rod 24. The clamping blade 36 has an outer free-end which terminates in a bead-like cylindrical enlargement 38 which not only strengthens the outer edge of the blade, but also reduces the tendency of the blade to damage materials which it is clamping.

The tubular hinge boss 28 has a crank arm 40 welded to it and extending outwardly from it. The crank arm 40 has a hole at the outer end and is attached to a clevis 42 by a pin 44. The clevis is in turn attached to the piston rod 46 of any hydraulic ram 48 which is tiltably supported between opposed trunnions 50. The hydraulic ram 48 is of the double acting type, and has two hoses 52 and 54 which are connected with the hydraulic system (not shown) in the tractor, and the position of the ram 48 is controlled by the third one of the control levers in the control unit K near the driver's seat of the vehicle.

The trunnions 50 are supported in holes in the second bracket means which include two bracket arms 56 which are welded to the support bar 20 in the position which can be seen best in FIG. 1.

OPERATION

The clamping assembly is supported entirely by the bucket itself and therefore moves with the bucket. By manipulation of the appropriate lever at the control box K, the piston rod 46 can be moved in and out of the hydraulic ram 48, thereby reciprocating the clevis 42 and drawing the crank arm 40 up or down through a series of selectible positions, as typified by the several positions of the crank arm 40 illustrated in FIG. 2. The hydraulic ram is free to tilt about the trunnions 50 which support it so as to keep the piston rod 46 always properly aligned with the hole in the outer end of the crank arm 40. It will be noted that the pivot point comprising the hinge rod 24 and also the trunnion axis 50 are both located outwardly of the rear wall 14 of the bucket and outwardly of the top edge 15 thereof, and that the parts are so located that the clamping blade 26–36 can be retracted well into the bucket toward the rear wall 14 thereof. By loosening the bolts 32, the clamping blade 36 can be moved even higher than its position as illustrated in FIG. 2, thereby permitting the blade 26–36 to be retracted inwardly even further toward the rear of the bucket.

When the piston rod 46 is retracted into the hydraulic ram, the clamping blade 36 is extended toward the position shown in FIG. 2 in dashed lines wherein it is located well above the outer scooping lip formed by the edge 17 of the bucket, leaving the bucket free to scoop up materials toward which the vehicle is driven. The clamping blade can then be lowered in the bucket until it contacts the materials and clamps them therewithin. This occurs when the appropriate lever of the control K is moved in such a direction to partially extend the piston rod 46 from the ram 48 and drive the crank arm 40 downwardly.

It will be noted that the edges 11 and 13 of the side walls of the bucket are straight lines, and that the hinge rod 24 is located just above these edges in a location wherein the clamping blades 26 and 36 can be lowered so as to occupy a position just overlying the plane containing the edges 11 and 13, whereby large sheet materials such as plywood sheet can be laid on the edges 11 and 13 and clamped thereagainst for secure transportation when the blade means 26–36 and the cylindrical bead 38 are lowered against the upper surface of the sheet material being supported.

The slots 30 can be made long enough so that the clamping blade can be expected considerably from its illustratd position, thereby increasing the height *h* of the blade means. In this way, the cylindrical bead 38 can be moved further outwardly of the scoop so that it more nearly approaches the edge 17 thereof.

Of course, it is realized that the illustrated shape of the bucket is not considered to be a limiting factor in the present invention since loop loader buckets are well known in various different shapes.

The present invention is not to be limited to the exact form shown in the illustrative embodiment of the drawings, for obviously changes may be made therein within the scope of the following claims.

I claim:

1. In a scoop loader including a material scooping bucket mounted on a vehicle which has an hydraulic system for positioning the bucket with respect to the vehicle, and the bucket having transversely spaced side walls and a rear wall, and having a bottom wall extending longitudinally in the outward directions from the rear will which joins a transversely extending top overlying an open space in the bucket above the bottom wall, a material clamping assembly comprising:

a. first bucket means attached to the top of the bucket and including brackets mutually spaced apart transversely of the bucket and carrying pivots aligned along a transverse axis, the axis of the pivots being displaced outwardly of said top and rear wall and being located above said open space of the bucket;

b. clamping blade means rotatably mounted on said pivots and having a transverse width approaching but less than the spacing between the side walls so that the blade means can be moved to a retracted position inside the bucket, the height of the blade means being such that its lower edge approaches the bottom wall of the bucket when the blade means is in retracted position;

c. a crank arm fixed with respect to the blade means and extending outwardly from said pivot axis;

d. second bracket means mounted to the top of the bucket above said axis of the pivots and having trunnion bearings located outwardly of the top and above said open space of the bucket; and e. an hydraulic ram having a body and having trunnion means located intermediate the ends of the body and mounted for rotation about said trunnion bearings in said second bracket means, and the ram having a piston rod coupled to said crank arm and operative under the control of said hydraulic system to move the arm selectively to orient the blade means in any position between retracted position and an extended position where the blade means extends outwardly from said pivot axis.

2. In a clamping assembly as set forth in claim 1, wherein the blade means has a substantially flat lower surface, and the side wall of the bucket have exposed straight line upper edges which are parallel to each other, and wherein said upper edges terminate at the end wall just below said axis of the pivots, whereby the blade means can be oriented to lie just parallel to said upper edges and slightly thereabove to pick up and support sheet materials.

3. In a clamping assembly as set forth in claim 1, said blade means comprising a blade portion having a free edge at its outer end, and said free edges having a bead-like enlargement extending therealong and approaching said lower edge when the blade means moves inside the bucket toward retracted position.

4. In a clamping assembly as set forth in claim 1, said clamping blade means comprising a hinge blade mounted on said pivots, and a clamping blade partially overlapping said hinge blade, the blades having slotted holes therethrough where they overlap, and bolt means through the slotted holes for clamping the blades together, the slotted holes being oriented normal to said axis to permit adjustment of the height of the blade means as measured normal to said axis.

* * * * *